United States Patent [19]

Evrard

[11] 4,235,661

[45] Nov. 25, 1980

[54] ARTICLE LABELLING MACHINE

[76] Inventor: Jacques E. M. Evrard, 20 avenue Jean Aicard, Paris, France

[21] Appl. No.: 969,716

[22] Filed: Dec. 15, 1978

[30] Foreign Application Priority Data

Dec. 16, 1977 [FR] France ..... 77 37974

[51] Int. Cl.[2] ..... B65C 9/06; B65C 9/18; B65C 9/36

[52] U.S. Cl. ..... 156/542; 156/566; 156/584; 156/DIG. 27; 156/DIG. 33; 156/DIG. 42

[58] Field of Search ..... 156/542, 541, 556, DIG. 8, 156/DIG. 25, DIG. 27, DIG. 33, 521, 566, 584, DIG. 42

[56] References Cited

U.S. PATENT DOCUMENTS

| | | | |
|---|---|---|---|
| Re. 24,097 | 11/1955 | Von Hofe | 156/556 X |
| 2,684,775 | 7/1954 | Von Hofe | 156/521 |
| 3,888,724 | 6/1975 | Spannknebel et al. | 156/542 X |
| 4,025,382 | 5/1977 | Del Rosso | 156/521 X |

FOREIGN PATENT DOCUMENTS

| | | |
|---|---|---|
| 2009816 | 3/1972 | Fed. Rep. of Germany . |
| 1056035 | 1/1967 | United Kingdom . |

*Primary Examiner*—Michael G. Wityshyn
*Attorney, Agent, or Firm*—Robert Scobey

[57] ABSTRACT

An article labelling machine, especially for labelling cheeses, comprises a conveying means for conveying the articles to be labelled and a labelling means.

The articles to be labelled are fed one-by-one to a stirrup which ensures the automatic centering of the articles with respect to a label-applying head overlying the stirrup. The stirrup and the label-applying head are movable as an assembly, transversely with respect to the direction of advance of the conveying means, from a position in which the label-applying head receives a label to a transversely displaced position in which the label is applied to an article and the labelled article is discharged from the machine.

9 Claims, 4 Drawing Figures

13
14
F3
12
9
30
10
6
7
28
15
16
27
25
11
29
3
1
2
19
21
2
20
23
22
F4
35
15
32
F5

13
14
F3
12
9
30
32
10
6
15
7
28
27
25
11
29
3
2
1
22
23
19
21
2
20
35

ARTICLE LABELLING MACHINE

This invention relates to a labelling machine which is intended particularly, but not exclusively, for labelling articles of soft consistency, for example cheeses.

For labelling such articles it is necessary to take particular precautions, taking into account that it is not possible to subject them to the pressures which are desirable in order to obtain satisfactory sticking of the labels. It is, in addition, necessary to support the articles permanently in the course of the various movements to which they are subjected.

Labelling machines are known in which the articles to be labelled pass in a row before a labelling device. However, these machines have the disadvantage that they do not allow the application of a suitable pressure and, in the case of articles of irregular shape, the centering is sometimes defective.

The present invention aims to overcome the disadvantages mentioned above.

According to the invention, a labelling machine, especially for articles of pasty consistency, comprising means for conveying the articles to be labelled and labelling means for the articles including a label distributor, is characterised in that the articles are fed one-by-one by said conveying means into a stirrup the internal shape of which corresponds to part of the external shape of the articles in order to achieve an automatic centering of an article in relation to a label-applying head mounted above said stirrup, the assembly of the stirrup and the labelling head being mounted on lateral guiding means in order to permit its disengagement from the label distributor and the bringing of a labelled article into position for discharge from the machine.

Figure 1:
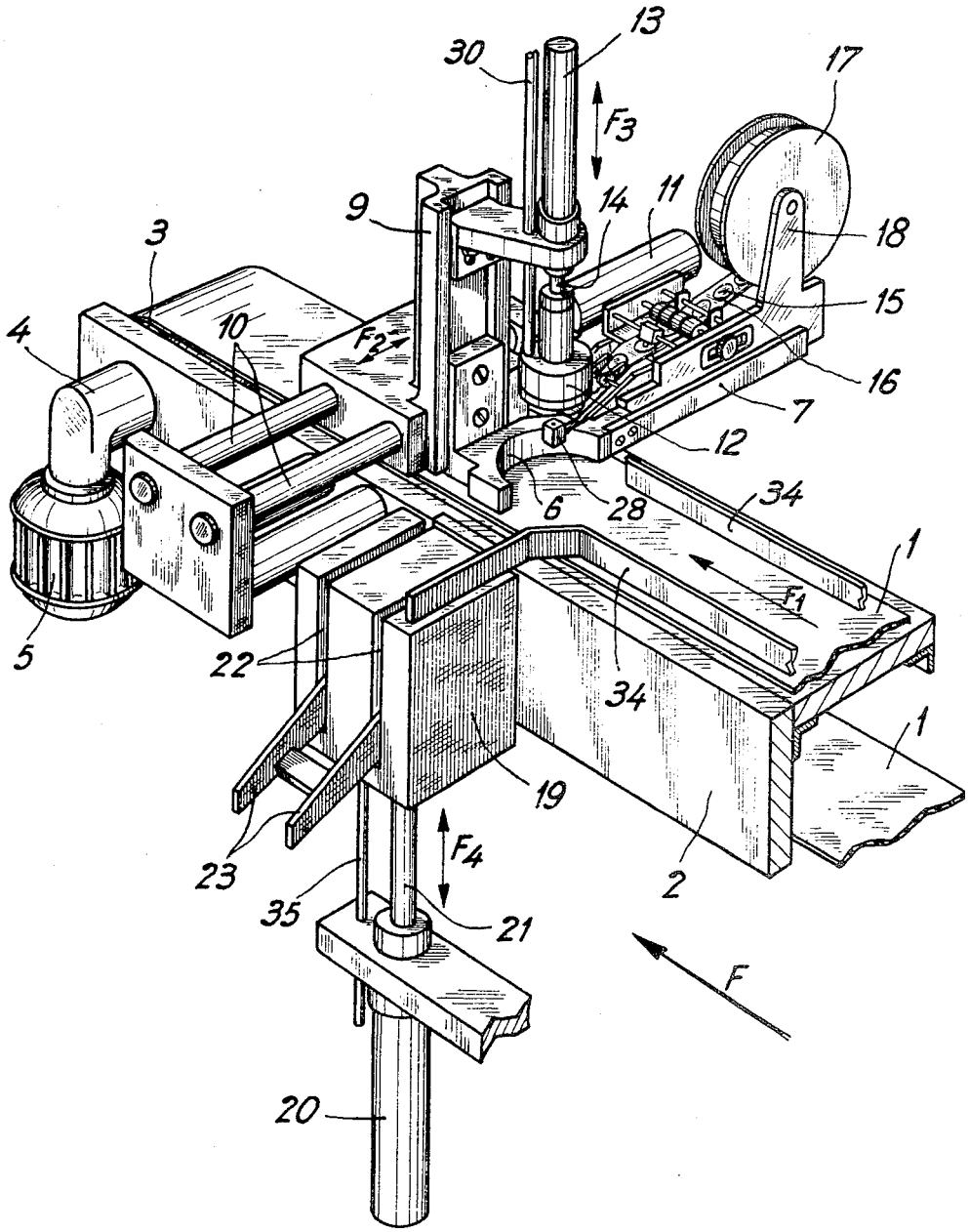
Figure 2:
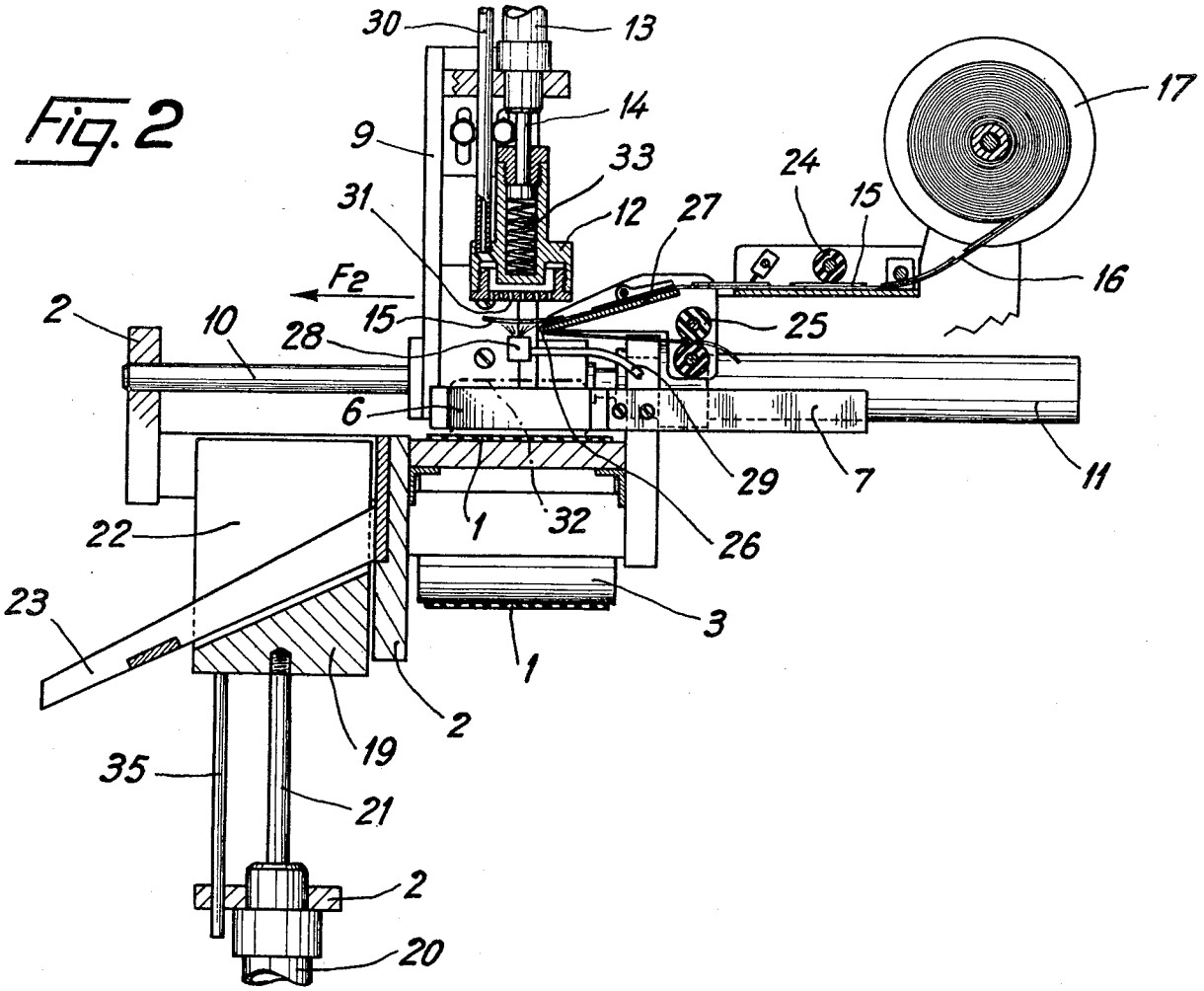
Figure 4:
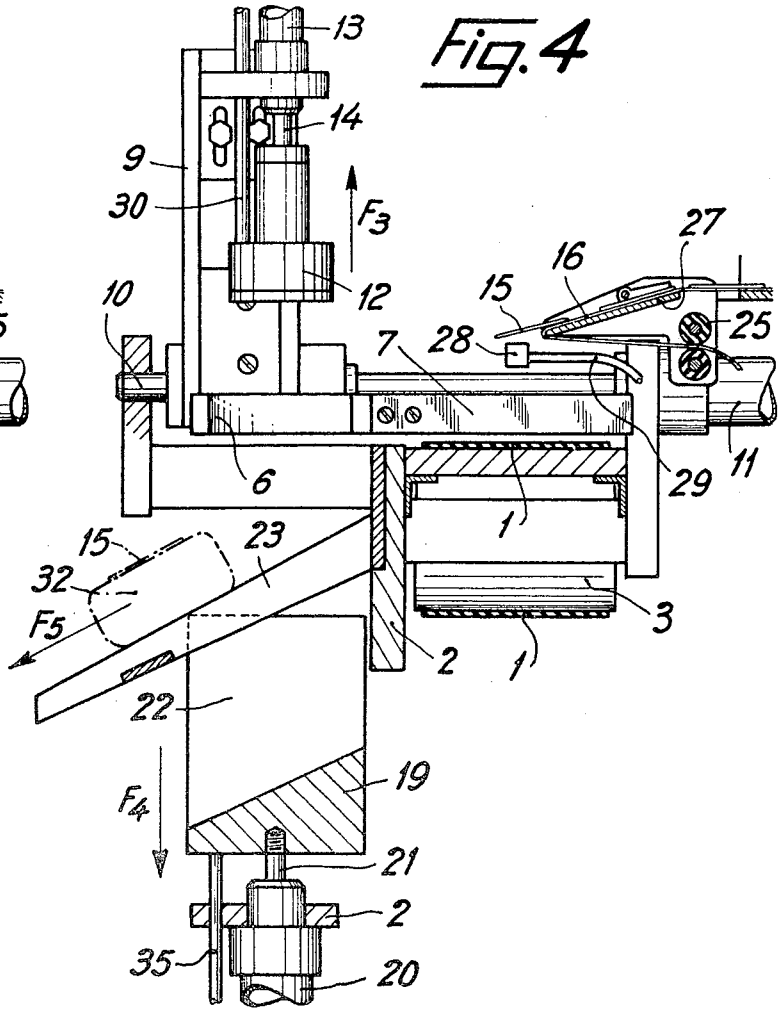
Figure 3:
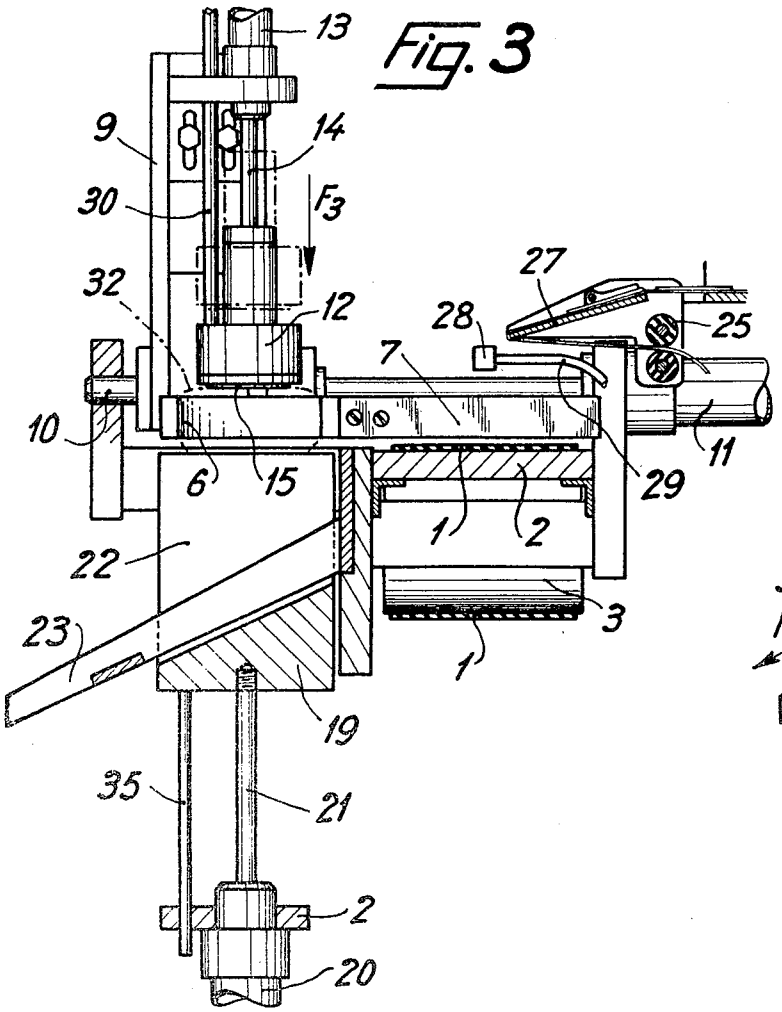

The invention will now be described, by way of example, with reference to the accompanying drawings, in which FIG. 1 is a perspective view of a cheese labelling machine in accordance with the invention, FIG. 2 is a partially sectioned view in the direction of the arrow F in FIG. 1 showing the parts of the machine in the positions they occupy when a label is detached from its support, FIG. 3 is a view similar to FIG. 2 but showing the parts of the machine in the positions they occupy at the moment of application of a label to a cheese, and FIG. 4 is a view similar to FIG. 2 but showing the parts of the machine in the positions they occupy at the end of a labelling operation.

In the machine shown in FIG. 1, cheeses are brought into the machine on an endless band conveyor 1 mounted on a frame 2 and driven by a roller 3 which in turn is driven, via a reduction gear 4, by a motor 5. The band conveyor 1 may be driven continuously or intermittently.

The cheeses are carried by the upper flight of the conveyor 1, in the direction of the arrow $F_1$, between guides 34 and arrive, abutting one another, with the leading cheese against a stirrup 6 fixed to a movable barrier 7. The stirrup 6 and the barrier 7 are fixed to a support 9 which is movable on slides 10, in a direction perpendicular to the direction of movement of the upper flight of the conveyor 1, under the action of a piston and cylinder assembly 11. The support 9 carries a labelling head 12 which can perform a vertical reciprocating movement, indicated by the arrows $F_3$, under the influence of a piston and cylinder assembly 13, the labelling head 12 being carried at the lower end of the piston rod 14 of the assembly 13.

Labels 15, coated on one side with adhesive, are disposed on a flexible, ribbon-like support 16 which is wound on a bobbin 17. This bobbin is rotatably mounted on a support 18 fixed to the frame 2.

On the opposite side of the conveyor 1 from the bobbin 17 there is a block 19 which is vertically reciprocable, as indicated by the arrows $F_4$, under the influence of a piston and cylinder assembly 20 having a piston rod 21 fixed to the block 19. The block 19 has two vertical grooves 22 in its upper surface into which project two inclined ramps 23, the purpose of which will be described hereinafter.

FIG. 2 shows a first stage in the labelling of a cheese in the machine. In the course of this stage, the label-conveying support 16, guided by a roller 24, is drawn along by nip rollers 25. In the course of this movement of the support 16, it is drawn around the edge 26 of an inclined plate 27. This movement of the support 16 causes the separation, or at least initiates the separation, of a label 15 from the support 16, due to the different elasticities of the labels 15, on the one hand, and the support 16, on the other hand. A nozzle or blower 28 connected to a compressed air line 29 assists the detachment of the label 15. In addition, the detached label is sucked up by the labelling head 12. The latter has a hollow interior which is connected to a vacuum line 30, and the sub-atmospheric pressure in the interior of the head 12 is communicated to the lower face of the head through holes 31. As a result, the label 15 detached from the support 16 is sucked up by the labelling head 12 and is maintained against the lower face of the latter (by, of course, the non-adhesive side of the label). After passing round the edge 26 of the plate 27, the label support 16 is wound up and recovered on a receiving bobbin (not shown). In FIG. 2 there is shown in chain lines a cheese 32 which, under the action of the band conveyor 1, has been brought into abutment with the stirrup 6. The rod 14 actuates the labelling head 12 via a spring 33, enabling a damped pressure to be obtained on the cheeses to be labelled.

FIG. 3 shows the state of the machine at the instant of the labelling of a cheese. This state follows immediately the state of the machine that has just been described with reference to FIG. 2. After the sucking up of a label 15 by the labelling head 12, the support 9 is displaced, in the direction indicated by the arrow $F_2$ in FIG. 2, into the position shown in FIG. 3. The labelling head 12 then descends under the influence of the piston and cylinder assembly 13 in order to apply the adhesive-coated face of the label on the upper surface of the cheese 32. As the support 9 moves to the left in FIG. 3, the barrier 7 closes the space previously occupied by the cheese 32 on the conveyor 1. Of course, the suction applied through line 30, which maintains the label 15 against the lower face of the labelling head 12, is suppressed at the instant when the labelling head 12 applies the label to the cheese 32.

The state of the machine shown in FIG. 4 is the state which immediately follows the application of a label to the cheese 32. This application takes place with the cheese supported by the block 19, the vertical movement of which block, under the influence of the piston and cylinder assembly 20, is guided by a rod 35 slidable in the frame 2. When a label 15 has been applied to the cheese 32 supported on the block 19, the labelling head 12 is returned to its upper position by the piston and cylinder assembly 13, as indicated by the arrow $F_3$, and the block 19 descends under the action of the piston and cylinder assembly 20, carrying with it the labelled cheese 32. As previously mentioned, inclined ramps 23 penetrate into the interior of the grooves 22 provided in the block 19. When the cheese 32 descends, following the movement of the block 19, it is received on the ramps 23 and separates from the block 19. It is then discharged from the machine down the ramps 23, in the direction indicated by the arrow $F_5$, under the influence of its own weight.

When the cheese has been discharged in this way, the block 19 ascends again to return to its upper position, and the support 9 moves towards the right. This movement of the support 9 removes the barrier 7 from the path of the leading cheese on the conveyor 1, and this cheese then enters the stirrup 6. The machine is thus returned to the state shown in FIG. 1.

It is evident that the actuations of the piston and cylinder assemblies and other moving parts of the machine have to be synchronised by a suitable control circuit (not shown), the constitution of which will be obvious to the person skilled in the art.

The labelling machine which has just been described enables a good centering of the labels to be obtained, irrespective of the shape of the articles to be labelled. This centering results in particular from the symmetry of the stirrup 6 which leads the articles onto the block 19.

Although in the embodiment described and illustrated the articles to be labelled are of round shape, it is of course possible to label articles of any other shape, in particular square articles, by modifying the shape of the stirrup 6.

Instead of discharging the labelled articles by means of the ramps 23, the discharge may be effected by depositing the labelled articles on endless conveyor belts passing through the grooves 22 in the block 19. Again, the labelled articles may be discharged in a horizontal plane, particularly in the case of square or rectangular articles, by arranging for one article to push another.

Furthermore, although the labelling head 12 and the block 19 in the embodiment illustrated are actuated by piston and cylinder assemblies, which may be pneumatically controlled, it is possible to actuate these parts by means of cams, the drive then being purely mechanical.

I claim:

1. An article labelling machine comprising means for conveying the articles to be labelled and labelling means for the articles including a label distributor, characterised in that the articles are fed one-by-one by said conveying means into a stirrup the internal shape of which corresponds to part of the external shape of the articles in order to achieve an automatic centering of an article in relation to a label-applying head mounted above said stirrup, the assembly of the stirrup and the label-applying head being mounted on lateral guiding means in order to permit disengagement of said assembly from the label distributor and the bringing of a labelled article into position for discharge from the machine.

2. A machine according to claim 1, comprising a vertically movable member having vertical grooves in its upper surface and disposed to one side of said conveying means under said assembly, when the latter is disengaged from the label distributor, and inclined ramps penetrating into said grooves, so that when said member descends, a labelled article resting thereon comes into contact with the inclined ramps and is ejected from the machine under the influence of the weight of said labelled article.

3. A machine according to claim 1 or 2, in which said stirrup is extended by a laterally movable barrier preventing the advancement of further articles by said conveying means while the labelling of an article is taking place.

4. A machine according to claim 1 or 2, in which said label-applying head is mounted on the vertically disposed piston rod of a piston and cylinder assembly, spring means being provided between said piston rod and the label-applying head.

5. A machine according to claim 1 or 2, in which said label distributor comprises a bobbin rotatably mounted on a support, said bobbin carrying a flexible band on which are disposed, at regular intervals, the adhesive labels to be applied to the articles, the flexible band being drawn around an edge to initiate detachment of the labels, one after another, from the flexible band.

6. A machine according to claim 5, in which, in being drawn around said edge, the flexible band is folded through an angle of slightly less than 360°.

7. A machine according to claim 5, in which means is provided for blowing a label upwardly, as it is detached from said flexible band, towards said label-applying head.

8. A machine according to claim 7, in which said label-applying head is provided with suction means to suck onto itself the upwardly blown label.

9. A machine according to claim 8, in which said label-applying head has a hollow interior connected to a vacuum line, the lower face of the label-applying head being provided with orifices which place the interior of the head in communication with said lower face.

* * * * *